United States Patent [19]

Kukanskis et al.

[11] 4,209,331

[45] Jun. 24, 1980

[54] ELECTROLESS COPPER COMPOSITION SOLUTION USING A HYPOPHOSPHITE REDUCING AGENT

[75] Inventors: Peter E. Kukanskis, Watertown; John J. Grunwald, New Haven; Donald R. Ferrier, Thomaston; David A. Sawoska, Woodbury, all of Conn.

[73] Assignee: MacDermid Incorporated, Waterbury, Conn.

[21] Appl. No.: 909,209

[22] Filed: May 25, 1978

[51] Int. Cl.[2] ..... C23C 3/02

[52] U.S. Cl. ..... 106/1.23; 106/1.26; 427/305; 427/437; 427/443.1

[58] Field of Search ..... 427/430 A, 437; 106/1.23, 1.26

[56] References Cited

U.S. PATENT DOCUMENTS

| | | | |
|---|---|---|---|
| 3,650,777 | 3/1972 | Schneble | 427/437 |
| 3,716,462 | 2/1973 | Jensen | 106/1.23 |
| 3,870,526 | 3/1975 | Pearlstein | 106/1.23 |
| 4,138,267 | 2/1979 | Arisato et al. | 106/1.23 |

OTHER PUBLICATIONS

Fintschenko et al, "Electroless Copper Plating" Metal Finishing, Jan., 1970, pp. 85–87.

*Primary Examiner*—John D. Smith

*Attorney, Agent, or Firm*—St. Onge Steward Johnston Reens & Noë

[57] ABSTRACT

Electroless copper deposition solutions, and method of electrolessly depositing copper onto a workpiece using these solutions, are disclosed. The solutions contain, in addition to water as the usual solvent, a soluble source of copper ions, a complexing agent or mixture of agents to maintain the copper in solution, and a copper reducing agent effective to reduce the copper ions to metallic copper as a deposit or plating on a prepared surface of a workpiece brought into contact with the solution. The invention comprehends replacing the usual formaldehyde-type reducing agents of commercial electroless copper baths with non-formaldehyde-type agents, specifically hypophosphites, by coordinating the particular complexing agents employed and the bath pH, to effect reduction of cupric ions to a metallic copper plating on a prepared surface of a substrate, wherein the resulting electroless metal deposit has conductive properties at least satisfactory for build-up of additional thickness of metal by standard electroplating techniques. Improvement over the prior formaldehyde-reduced electroless copper solutions is obtained in that the invention teaches those skilled in the art how to achieve satisfactory copper deposition over longer periods of bath operation than has been practical heretofore. Fluctuations in component concentration and bath temperatures are inherent and unavoidable in the course of commercial use of the bath and these are normally detrimental to protracted use of formaldehyde-reduced copper solutions. In the present invention, bath stability is maintained better, in spite of these inherent fluctuations.

20 Claims, No Drawings

ELECTROLESS COPPER COMPOSITION SOLUTION USING A HYPOPHOSPHITE REDUCING AGENT

BACKGROUND OF THE INVENTION

1. Field of the Invention

The present invention relates to electroless deposition of copper (or possibly an alloy predominating in copper) from a solution in which copper ions are dissolved, in order to provide a metal deposit or film on a desired, suitably-prepared, substrate when immersed in or contacted by the solution, without the employment of external electrical energy to bring about such reduction. The invention relates more particularly to electroless copper baths employing a non-formaldehyde type reducing agent, and more particularly a soluble hypophosphite reducing agent, for effecting conversion of the copper ions to copper metal in order to form adherent, highly conductive metal films on controlled surfaces of substrates, particularly nonconductive substrates.

2. Description of the Prior Art

The conventional electroless plating art as commercially practiced in the deposition of copper onto various substrates, especially nonconductive substrates, almost without exception today uses highly alkaline formaldehyde solutions of divalent copper complexed with various well-known agents such as Rochelle salt, amines and others. A current survey of the practical art is summarized in an article entitled "Electroless Copper Plating", by Purhpavanam and Shenoi, published in "Finishing Industries", October 1977, pages 36 et seq. The article lists the various components of electroless copper plating solutions, and discusses useful alternatives in each category. With respect to available agents for reducing the copper ion of the bath, the article lists hypophosphites, phosphites, hyposulfites, sulfites, sulfoxylates, thiosulfates, hydrazine, hydrazoic acid, axides, formaldehyde, formate and tartrate as having been tried. Hypophosphite is stated to be "very effective in alkaline or acid solutions", but the article does not define what is meant by this and goes on immediately to report that "this operates only at higher temperatures and under these conditions there appears to be a rapid reduction of copper in the bulk of solution." In other words decomposition of the solution occurs, resulting in the bath being of no further use for electroless plating. Other reducing agents from the abovementioned list are also discussed, more particularly hydrazine, borohydride and dimethylamine borane. The article states that "The best reducing agent for copper is considered to be formaldehyde." and later concludes that "No other reducing agent is capable of replacing formaldehyde and hence on(sic) (only?) the Fehlings-formaldehyde solution with modifications is maintaining its superior position in electroless copper plating."

In an article entitled "Fabrication of Semitransparent Masks", Feldstein and Weiner, J. Electrochemical Soc., Vol. 120, pp 1654–1657 (December 1973), the use of hypophosphite reducing agent is described in connection with production of semitransparent resists or masks, using an alkaline copper sulfate, EDTA-complexed, bath. The article indicates that the resulting film deposited on a catalyzed substrate immersed in such bath is cuprous oxide ($Cu_2O$), and concludes that reduction of copper ions to metallic copper does not take place to any appreciable extent in a hypophosphite-reduced system. The article further reports that the deposited cuprous oxide does not provide sufficient catalytic activity for continuation of the plating process.

An earlier study entitled "Electroless Copper Plating in Printed Circuitry", E. B. Saubestre, The Sylvania Technologist, Vol. XII, No. 1, January 1959, also considered the reactions of copper ions in solutions containing a hypophosphite reducing agent, and reported work on attempted reduction of copper in alkaline hypophosphite solution as well as in alkaline hyposulfite and formaldehyde solutions. In order to obtain copper by chemical reduction, it was found necessary by the author to have either a system in which there is little tendency for the cuprous ion to form, or one in which the cuprous ion is rendered soluble by formation of a suitable complex ion. Of the various solutions tested, only the following four combinations were found to offer promise:

(a) Fehling's solution with formaldehyde
(b) Fehling's solution with hydrazine sulfate
(c) Acid sulfate solution with sodium hypophosphite
(d) Acid sulfate solution with sodium hyposulfite.

It was reported that investigation of these possibilities revealed that copper is a pronounced reduction catalyst only in the Fehling's-formaldehyde solution, so further work was accordingly concentrated along that line. Supplementing this article is another by the same author which appears in Technical Proceedings of the Golden Jubilee Convention of American Electroplaters Society, Vol. 46, pages 264 et seq; 1959. In this article a comprehensive review is presented on reducing agents for copper, and particularly sodium hypophosphite in a series of different types of copper solutions. The conclusion reached was that "In general, this reducing agent shows little promise except in Fehling's and sulfate solutions operated at high temperatures and high hypophosphite concentrations. However, under these conditions, there appears to be rapid reduction of copper in the bulk of the solution as well." In other words the solutions decompose and cannot be used on a continuing basis and particularly not over an extended period of time. Hyposulfite was also investigated and the conclusion reached was that it "is more effective than hypophosphite, but again, since deposition tends to occur throughout the solution, this reducing agent probably lends itself only to spraying applications". That is, one involving continuous spraying of separate streams, one containing copper ions, the other the reducer. Such conditions of operation are commercially noneconomic and totally impractical.

The technical literature clearly establishes that while hypophosphite agents are effective and universally used as reducing agents in electroless nickel deposition techniques, they have not been found useful practically for electroless copper deposition. For copper, formaldehyde is the overwhelming choice in commercial plating today. The only viable alternatives even mentioned are borohydride, dimethylamine borane and hydrazine.

The patent literature confirms the foregoing practical experience and conclusion. U.S. patents directed specifically to electroless copper issuing between 1960 and 1977 almost invariably list formaldehyde or formaldehyde precursors, many times giving these as the only reducing agents although borohydrides and boranes appear in several patents, and there is occasional reference to hydrazine. There are a few references to alkali metal hypophosphites and hydrosulfites; but in the case of hypophosphites the disclosures relate solely to acid solutions operating at pH levels of 3.0 or less. For example, U.S. Pat. No. 3,046,159 mentions the use of hypophosphite reducing agents in plating by chemical reduction from a solution containing a normally insoluble copper compound, such as cupric oxide, in conjunction with an ammoniacal compound such as ammonium sulfate or ammonium chloride, to which sodium hypophosphite is added as the reducing agent. In all examples the solution is strongly acid (pH 3.0 or less). In order to increase the plating rate the patent recommends that the solution temperature be increased, but also recognizes that this leads to instability and great difficulty in preventing complete collapse of the system. Attempts to duplicate the teaching of this patent using standard, properly cleaned copper-clad panels, have produced only a brownish oxide deposit. When the teaching is applied to a nonmetallic substrate, such as a standard ABS of platable grade suitably prepared (catalyzed) for electroless plating, the cupric oxide particles in the bath form on the surface along with a reddish, non-adherent deposit which rubs off on the fingers when touched. Attempts to electroplate the coated substrate failed completely because the deposit simply burns off, proving that it is essentially non-conductive, leading to the conclusion that it is not metallic copper or at least is not significantly so.

It is interesting to note that other U.S. Pat. Nos., such as 3,403,035; 3,443,988; 3,485,653; 3,515,563; 3,615,737; and 3,738,849, these being the only others currently known to the present inventors which contain reference to hypophosphites as reducing agents in electroless copper bath, also relate to strongly acid copper solutions. It is clear from these patent disclosures that alkaline formaldehyde systems, which are generally always also mentioned, are those actually considered to be useful in practice.

A recent U.S. Pat. No. 4,036,651 teaches incorporation of sodium hypophosphite as a "plating rate adjuster" in an alkaline formaldehyde type electroless copper solution. The patent states expressly "Although sodium hypophosphite is, itself, a reducing agent in electroless nickel, cobalt, palladium and silver plating baths, it is not a satisfactory reducing agent (i.e., will not reduce $Cu^{++} \rightarrow Cu^{\circ}$) when used alone in alkaline electroless copper plating baths. In the baths of the present invention [U.S. Pat. No. 4,036,651], the sodium hypophosphite is not used up in the plating reaction. Instead, it appears to act as a catalyst." (Bracketed insert added).

In the prior patents, where both electroless nickel as well as copper baths are disclosed, the bath composition examples invariably employ formaldehyde-type reducing agents for the copper formulations and, in contrast, hypophosphites for the nickel formulations. There is no suggestion in the patent art that the hypophosphite of the nickel baths could be substituted for formaldehyde in copper baths. See U.S. Pat. Nos. 3,370,974; 3,379,556; 3,617,363; 3,619,243; 3,649,308; 3,666,527; 3,668,082; 3,672,925; 3,672,937; 3,915,717; 3,977,884; 3,993,801 and 3,993,491.

As is commonly known to those skilled in the electroless plating industry, commercially satisfactory electroless copper baths have required formaldehyde-type reducing agents and operate at high pH levels (11–13), using complexing agents to maintain the copper in solution. Such baths are effective from the standpoint of adequate rate of deposit, as well as quality of deposit and adherence to a substrate. Still, the baths are inherently unstable over long periods of use and require incorporation of "catalytic poisons" in carefully controlled trace amount to avoid spontaneous (bulk) decomposition. The plater must therefore always operate in a relatively narrow range between conditions which are conducive to satisfactory deposition on controlled areas of a substrate on the one hand, and random, unwanted, copper plate-out on tank walls, racks, etc., on the other. Continuous filtering of the solution and frequent cleaning of the plating tank, etc. is usually required. This is expensive in terms of time and labor, as well as in chemical component losses. Formaldehyde-type electroless copper baths are also prone to the Cannizzaro reaction, with accompanying wasted consumption of bath ingredients on that account. Additionally, formaldehyde is a volatile chemical. The bath vapors can be toxic and must accordingly be appropriately handled, which introduces environmental control problems.

SUMMARY OF THE INVENTION

The invention here relates to the discovery that hypophosphite reducing agents can be usefully employed in commercial installations as a reducer for divalent copper in electroless plating baths to produce an electrically conductive metallic base or film on suitably prepared substrates, and particularly on catalyzed non-conductive substrates. Such copper deposit has good conductivity, provides good adherence of the deposit to the substrates, and serves as an excellent base for electrolytic deposition of additional copper or other metals.

One of the important keys to this invention lies in the discovery that for each complexing agent employed in conjunction with the reducing agent, there is an optimum pH range for successful operation of the bath. Further supplementing this in ensuring satisfactory deposits under the invention are adequate surface preparation of the substrate, with special attention to catalytic preparation, and acceleration treatment of the catalyzed substrate. Additionally it is found desirable to avoid excessive work agitation or high turbulence of the plating solution in the novel baths. In the subsequent electrolytic deposition of additional metal on the electroless copper base, the plating should be carried out, at least initially, under controlled current density condition to avoid burning of the base at the contact points on the work where connection to the plating bus is made. Further discussion of these factors appears hereinafter.

One of the principal advantages of the novel electroless copper bath is that a more stable bath is provided, having greater tolerance to changes inevitably encountered in practical commercial operation. That is, the plating baths of this invention allow wider operating parameters in terms of component concentration, temperature, plating time, etc., so that such parameters are more nearly comparable to those typically encountered in commercial electroless nickel baths. The latter baths have characteristically not needed the sophisticated component monitoring and complex monitoring equipment that formaldehyde-reduced copper baths require. Bath maintenance is accordingly greatly simplified in the use of the novel baths, and consumption of ingredients is closely confined to plate-out on catalyzed surfaces only. Tank clean-out is infrequently necessary and the plating solution need not be so carefully filtered or completely replaced as is the case with formaldehyde-type baths. In addition, the novel baths, by eliminating formaldehyde, get rid of problems due to the volatility of that reducing agent, as well as its tendency to undergo the Cannizaro side-reaction. All of these considerations take on added significance under actual "plating shop" conditions where operation may be supervised by semi-skilled personnel or where the operations are partially automated.

DESCRIPTION OF THE PREFERRED EMBODIMENT

Plating solutions embodying the invention concept include the usual major categories of components of conventional electroless copper baths; namely, a source of cupric ions and a solvent for these, usually water; complexing agent or mixtures thereof; and hypophosphite reducing agent. The use of this agent is indeed surprising and quite unexpected, given the teaching and experience of the prior art.

The copper source in the plating solutions may be comprised of any known suitable soluble copper salt. Copper chloride and copper sulfate are usually preferred because of availability.

As will be discussed in detail presently, proper pH level of the copper bath is important to the operability of the novel copper solutions. If adjustment of pH is needed, any suitable standard acid or base may be employed to return the level to correct operating range. Continued liberation of acid during plating lowers the pH of the bath with time, so some adjustment will be required for extended periods of use. In general it is preferred to use as pH adjusters those compounds which furnish at least one of the same ions as already introduced by the copper compounds. For example, if greater bath acidity is needed hydrochloric acid is preferred where copper chloride is used; or sulfuric acid where copper sulfate is the copper source. In the case of alkaline adjusters, sodium or potassium hydroxide is preferred. However, so long as the extraneous ion introduced via the adjuster does not interfere with other components of the bath, it's particular chemical identity is not important. Employment of a buffer, such as sodium acid phosphate, sodium phosphite, etc., aids in maintaining the selected pH range.

The most effective complexing agents now known for the hypophosphite-reduced electroless copper baths of the invention are N-hydroxyethyl ethylenediamine triacetic acid (HEEDTA), ethylenediamine tetraacetic acid (EDTA), nitrilotriacetic acid (NTA), and alkali metal salts of these; also the tartrates and salts of these. The operating ranges in terms of pH of the plating solutions are generally effective from slightly acidic to an essentially alkaline condition. A minimum pH of at least 5 is found essential, at which level the copper deposit obtained may be suitable provided any imperfections will be adequately covered by subsequently applied other deposits. In general, amine type complexers show operability at pH of about 5–11, while tartrate complexers are operable from about pH 9–13. Optimum results are obtained by working within somewhat more restricted limits of the broad ranges mentioned; for example from about 6 to 10 for the amine-complexed baths, and about 10–11 for tartrate complexed baths, as will be more apparent hereinafter. However within the designated range, the system generally is more tolerant to small changes than conventional formaldehyde-reduced systems. Concentration of the amine complexer in solution is preferably at about one-to-one on a mole ratio basis with the cupric ion, while the tartrate and NTA complex concentration is on a two-to-one mole ratio basis. Lesser amounts of complexer will of course leave some copper uncomplexed. This can be tolerated within limits provided precipitation of particles is insufficient to interfere with the desired degree of luster, smoothness, etc. in the finished plate. Increased filtering can compensate to some extent for a condition of insufficient complexer concentration. On the high-ratio side, there is no problem, an excess of complexer does not hinder the operation of the bath and in fact a slight excess can be helpful to accommodate for conditions of temporary, locally high copper concentration which may arise during bath replenishment operations.

Sodium hypophosphite is the most readily available hypophosphite material and is accordingly the preferred form of this reducing agent. Hypophosphorous acid however is also available and could be used in conjunction with pH adjusters, which would probably be required in preparing a bath of this material. As to concentration, the optimum is that level which is sufficient to give an adequate copper film in a reasonable period of time. The system will work with less reducer but of course not all of the available copper can be deposited from such a solution unless more hypophosphite is added during operation of the bath. Working with a large excess of reducer over the stochiometric amount needed to reduce all the copper in solution does not impede the bath operation, but neither does it have any advantage.

The reaction involved in electrolessly plating a catalytic substrate using bath compositions of the present invention is thought to be best represented by the following summarizing equation:

$$Cu^{++}+2H_2PO_2^-+2H_2O \rightarrow Cu^{\circ}+2H_2PO_3^-+2H^++H_2 \rightleftarrows$$

The following examples illustrate preferred conditions for practicing the invention

EXAMPLE I

A typical workpiece comprising an automotive component molded of standard commercial plating grade ABS is first cleaned to remove surface grime, oil, etc. An alkaline cleaning solution as typically used in prior plating systems may be used here also. This is followed by chemical etch using mixed chromic-sulfuric or all chromic acid, also standard in the industry. Typical operating conditions, concentrations and time of treatment are disclosed in U.S. Pat. No. 3,515,649. Following thorough rinsing, the workpiece is catalyzed. This can be accomplished in the "one-step" method using a mixed palladium-tin catalyst of commercial type. Such a catalyst is disclosed in U.S. Pat. No. 3,352,518, along with its method of use. Following rinsing, the catalyzed workpiece is next placed in a so-called "accelerating solution" to reduce or eliminate the amount of residual tin retained on the surface since tin tends to impede copper deposition. Again, many types of accelerating baths can be employed, for example the one disclosed in the above mentioned U.S. Pat. No. 3,352,518, such accelerating baths generally consisting of an acid solution. Alkaline accelerators such as sodium hydroxide solution have also been used successfully.

The workpiece is then ready after further rinsing for copper plating. The novel copper bath used in this example has the following composition:

| | | |
|---|---|---|
| $CuCl_2 . 2H_2O$ | 0.06M | (10 g/l) |
| "Hamp-O1" (HEEDTA) | 0.074M | (26 g/l) |
| $NaH_2PO_2 . H_2O$ | 0.34M | (26 g/l) |
| Water | | |
| pH adjuster (HCL/NaOH) (as needed) | pH 9 | |

The bath is maintained at 140°-150° F. (60°-66° C.) and when the work is immersed in it for 10 minutes, the thickness of copper plate obtained is 9.2 microinches. In 20 minutes the thickness of deposit is 10.5 microinches. The deposit is bright pink, a visual characteristic indicating good electrical conductivity. Coverage is complete on the catalyzed surface, and the deposit is well-adhered, is free of blisters and roughness. This electroless plated substrate is rinsed, then placed in a standard electrolytic copper strike bath similar to any of those described in U.S. Pat. Nos. 3,203,878, 3,257,294, 3,267,010 or 3,288,690, for example. Initially the electroplating is carried out at about 2 volts at a rate of about 20 amperes per square foot. Generally this is maintained for about 1½ minutes, or until the thickness of deposit is sufficient to provide greater current-carrying capability. At such time the plating rate may then be increased, as for example to about 4 volts at 40 amperes per square foot, until the total required thickness of copper is obtained. The workpiece may be further electroplated with nickel, chromium, gold, etc., as may be required for any given application, using standard electroplating techniques. Much of the restriction on initial current density depends on the size and complexity of parts, along with the amount of rack contact area available per area of workpiece. If enough contacts are used, the need to monitor initial current densities is less critical; however in production experience, adequate rack contacts cannot always be found.

Peel strength tests on plated workpieces obtained from baths in accordance with this example show adherence values of about 8-10 pounds per inch for the copper deposit on ABS substrates. Similar levels of peel strength are obtained for other thermoplastic substrates including polyphenylene oxide, polypropylene, etc., as well as thermosetting substrates such as phenolic, epoxy, etc.

EXAMPLE II

An electroless copper bath identical in all respects to that of the foregoing example is prepared except that a different complexer is used. In this case, the complexer is "Hampene $Na_4$" (tetrasodium EDTA) at the same concentration (0.074 M) as before and the pH is again 9. At a bath temperature of 140°-150° F., a bright pink electroless copper deposit of 6.6 microinches is obtained in 10 minutes, which increases to 8.3 microinches in 20 minutes. Coverage of the workpiece is complete on the catalyzed surface, and the deposit is free of blisters and roughness and is well adhered to the substrate. The deposit forms an excellent base for further metal plating to build up a desired total thickness. When so plated, adhesion tests made on the ABS substrate plated in accordance with this example show peel strengths which range from 8-10 pounds per inch.

EXAMPLE III

Another ABS workpiece is prepared for electroless plating in the manner described. The electroless copper bath here is again identical to that of the first example except for complexer, which in this case is nitrilotriacetic acid (NTA) at 0.148M. At a solution pH of 9, a bright pink adherent copper deposit of 12.1 microinches is obtained. After being further plated with additional copper, nickel, chromium or the like, to build up a desired thickness, adhesion values of 8-10 pounds per inch peel strength on ABS is recorded.

EXAMPLE IV

The copper bath in this example is again the same as in the others except for complexer, which in this case is sodium potassium tartrate at 0.148 M and the bath pH is adjusted to 11. An ABS substrate, prepared as indicated above, when immersed in this solution develops a copper deposit of 19 microinches in 10 minutes at a bath temperature of 140°-150° F. Coverage is complete on the catalyzed surface and a peel strength of 8-10 pounds per inch is indicated after further electrolytic plating to build up the desired total thickness of the deposit.

In order to illustrate the effect of further variations in plating conditions, in terms of type of complexer used, changes in its concentration as well as in concentration of copper, incorporation of surfactants and some other factors, as will be noted, the following tabulations summarize results obtained in testing the four specific complexers of the foregoing examples. In every case except as otherwise noted in the tables, the bath composition and conditions are standard; i.e. are the composition and conditions given in Example I above.

TABLE A

COMPLEXER - TRISODIUM N-HYDROXYETHYL ETHYLENEDIAMINE TRIACETATE HYDRATE @ 0.074M $Cu^{++}$ @ 0.06M

| Ex. No. | Moles Reduc. | pH | $Ni^{++}$ [a] | Plate Thickness[b] 10 Min. | Plate Thickness[b] 20 Min. | % Cover[c] | Deposit Color | Accpt.[d] | Comment |
|---|---|---|---|---|---|---|---|---|---|
| 1 | 0.34 | 12 | Yes | 9.3 | — | 100 | dk. purple | No | |
| 2 | 0.34 | 12 | No | 11.8 | — | 100 | violet pink | Minimal | |
| 3 | 0.34 | 11 | Yes | 5.3 | — | 100 | purple | Minimal | |
| 4 | 0.34 | 11 | No | 5.8 | — | 100 | bluish | Minimal | |
| 5 | 0.34 | 9 | Yes | 8.8 | — | 100 | pink | Yes | |
| 6 | 0.34 | 9 | No | 9.3 | — | 100 | pink | Yes | |
| 7 | 0.34 | 6 | Yes | 8.4 | — | 100 | pink | Yes | |
| 8 | 0.34 | 6 | No | 9.6 | — | 100 | pink | Yes | |
| 9 | 0.34 | 4 | Yes | — | — | 40 | dk. brown | No | Smut deposit possibly $Cu_2O$ |
| 10 | 0.34 | 4 | No | — | — | 10 | dk. brown | No | Smut deposit possibly $Cu_2O$ |

TABLE A-continued

| Ex. No. | Moles Reduc. | pH | $Ni^{++}$ [a] | Plate Thickness[b] 10 Min. | 20 Min. | % Cover[c] | Deposit Color | Accpt.[d] | Comment |
|---|---|---|---|---|---|---|---|---|---|
| | | | COMPLEXER - TRISODIUM N-HYDROXYETHYL ETHYLENEDIAMINE TRIACETATE HYDRATE @ 0.074M $Cu^{++}$ @ 0.06M | | | | | | |
| 11 | 0.34 | 2.5 | Yes | 0 | — | 0 | — | No | No plate |
| 12 | 0.34 | 2.5 | No | 0 | — | 0 | — | No | No plate |
| 13 | 0.68 | 12 | No | 8.5 | — | 100 | lt. purple | Minimal | |
| 14 | 0.68 | 9 | No | 6.6 | — | 100 | pink | Yes | |
| 15 | 0.68 | 6 | No | 7.9 | — | 100 | pink | Yes | |
| 16 | 0.34 | 6 | No | 7.8 | 11.4 | 100 | pink | Yes | |
| 17 | 0.34 | 9 | No | 9.2 | 10.5 | 100 | pink | Yes | |
| 18 | 0.34 | 6 | No | 7.4 | — | 100 | off-pink | Yes | surfactant #1 |
| 19 | 0.34 | 9 | No | 8.8 | — | 100 | pink | Yes | surfactant #2 |
| 20 | 0.34 | 9 | No | 7.7 | — | 100 | pink | Yes | surfactant #3 |
| 21 | 0.34 | 9 | No | 8.2 | — | 100 | pink | Yes | surfactant #4 |

[a] $NiCl_2 \cdot 6H_2O$ @ 0.002M
[b] Microinches
[c] Surface coverage
[d] Electroplating acceptability
Surfactant #'s
1. 10 ppm Polyethelene Glycol
2. 10 ppm Diethylene Glycol
3. 10 ppm "Petro AG Special"
4. 10 ppm "Triton X-100"

In Table A, all bath compositions are 0.06 molar in copper. Examples Nos. 1-12 illustrate the effect of varying the pH of the bath while reducer (hypophosphite) concentration (0.34 M) and complexer concentration (0.074 M) are kept constant. This is done by adding hydrochloric acid or sodium hydroxide as needed. The reducer concentration of 0.074 M is selected to provide a workable concentration in the overall system, taking into account component solubility (saturation) problems, bath speed, etc. This first group of examples also provides a comparison of copper deposits obtained with and without nickel ion as an autocatalysis promoter in the plating bath. There appears to be no appreciable effect on this system by the addition of nickel.

This same group of tests further demonstrates that a bath pH of over 5 on the acid side, and up to about 11 on the alkaline side, represents practical operating limits for effective copper deposits in this particular type of complexed solution. By "effective" it is here meant deposits that would be suitable for commercial plating, which includes both initial electroless deposit and subsequently applied electrodeposit of additional copper or other metals to provide a final thickness of metal required by the functional or decorative requirements of the workpiece. This comprehends not only good adhesion but also good color (pink), the latter indicating absence of significant amounts of cuprous oxide inclusions which give rise to poor conductivity and poor autocatalysis, hence poor acceptability for subsequent plating operations.

Examples 13-15 of Table A show the effect of doubling the reducer concentration. Example 13 demonstrates that doubling the reducer concentration for a solution (e.g. Ex. 2) which is borderline for electroplating acceptability does not substantially improve the bath in that respect. Examples 14 and 15 further demonstrate that doubling the reducer concentration of a preferred solution (e.g. Ex. 6) again does not appreciably effect the plating rate. However the examples do illustrate that the stability of the bath is not adversely affected by doubling the reducer concentration, thus illustrating that the baths of the invention offer wide operating tolerances in terms of reducer concentration parameters.

Examples 16 and 17 show that plate-out is nonlinear since a drop-off in rate occurs as thickness increases. This also is evidence of stability of the bath; i.e. there is virtually little unwanted or extraneous plate-out on tank walls, racks, etc.

Examples 18-21 demonstrate that the usual surfactants can be incorporated in the baths without any adverse effect upon the plate obtained. Inclusion of wetters in the plating bath helps to disperse gas bubbles (hydrogen) produced in the course of the plating reaction, such bubbles commonly causing "pitting" phenomena to occur in the deposit. The proprietary surfactant "Triton X-100" is an alkyl aryl polyether, while "Petro AG Special" is an alkyl naphthalene sodium sulfonate.

Table B presents similar data for hypophosphite-reduced copper solutions of the invention, in which the complexer is ethylenediamine tetraacetic acid.

TABLE B

| Ex. No. | Moles Reduc. | pH | (a) Ni | (b) Plate Thickness 10 Min. | 20 Min. | (c) % Cover | Deposit Color | (d) Accpt. | Comment |
|---|---|---|---|---|---|---|---|---|---|
| | | | COMPLEXER - ETHYLENEDIAMINE TETRAACETIC ACID @ 0.074M $Cu^{++}$ (@ 0.06M | | | | | | |
| 22 | 0.34 | 12 | Yes | 10.8 | — | 100 | dk. purple | No | |
| 23 | " | 12 | No | 12.0 | — | 100 | violet/ pink | No | |
| 24 | " | 11 | Yes | | — | 100 | purple | Marginal | |
| 25 | " | 11 | No | 5.7 | — | 100 | yellow/ | Marginal | |

TABLE B-continued

| Ex. No. | Moles Reduc. | pH | (a) Ni | (b) Plate Thickness 10 Min. | 20 Min. | (c) % Cover | Deposit Color | (d) Accpt. | Comment |
|---|---|---|---|---|---|---|---|---|---|
| | | | | COMPLEXER - ETHYLENEDIAMINE TETRAACETIC ACID @ 0.074M $Cu^{++}$ (@ 0.06M | | | | | |
| | | | | | | | bronze | | |
| 26 | " | 9 | Yes | 5.3 | — | 100 | pink | Yes | |
| 27 | " | 9 | No | 7.0 | — | 100 | pink | Yes | |
| 28 | " | 6 | Yes | 5.7 | — | 100 | pink | Yes | |
| 29 | " | 6 | No | 5.2 | — | 100 | gray/pink | Yes | |
| 30 | " | 4 | Yes | — | — | 80 | dk. brown | No | Smut deposit |
| 31 | " | 4 | No | — | — | 100 | dk. brown | No | Smut deposit |
| 32 | " | 2.5 | Yes | — | — | 0 | — | No | No Plate |
| 33 | " | 2.5 | No | — | — | 0 | — | No | No Plate |
| 34 | 0.68 | 12 | No | 9.1 | — | 100 | lt. purple | Marginal | |
| 35 | " | 9 | No | 5.0 | — | 100 | reddish/ pink | Yes | |
| 36 | " | 6 | No | 4.7 | — | 100 | pink | Yes | |
| 37 | 0.34 | 6 | No | 5.4 | 6.7 | 100/ 100 | pink/pink | Yes | |
| 38 | " | 9 | No | 6.6 | 8.3 | 100/ 100 | pink/pink | Yes | |
| 39 | " | 6 | No | 5.3 | — | 100 | pink | Yes | Surfactant #1 |
| 40 | " | 9 | No | 6.6 | — | 100 | pink | Yes | Surfactant #2 |
| 41 | " | 9 | No | 6.0 | — | 100 | pink | Yes | Surfactant #3 |
| 42 | " | 9 | No | 6.9 | — | 100 | bronze | Yes | Surfactant #4 |

With respect to Table B, it will be seen that the baths of this group show substantially similar results for EDTA-complexed solutions as are found for HEEDTA-complexed ones. Best operating limits of bath pH are again from slightly above 5 to 11. Reducer concentration does not significantly effect bath operation within this pH range. Nickel ion is again not significant. Thickness of deposit obtained is somewhat lower in these EDTA-complexed baths than in those using HEEDTA, within the same time period. Again the solutions are compatible with inclusion of the common wetting agents.

Table C summarizes data on hypophosphite copper baths of the invention in which the complexer is nitriloacetic acid.

TABLE C

| Ex. No. | Holes Reduc. | pH | (a) Ni | (b) Plate Thickness 10 Min. | 5 Min. | (c) % Cover | Deposit Color | (d) Accpt. | Comment |
|---|---|---|---|---|---|---|---|---|---|
| | | | | COMPLEXER - NITRILOTRIACETIC ACID @ 0.148M $Cu^{++}$ @ 0.06M | | | | | |
| 43 | 0.34 | 12 | Yes | — | — | — | — | No | Solution decomposed |
| 44 | " | 12 | No | — | — | — | — | No | Solution decomposed |
| 45 | " | 11 | Yes | 5.2 | — | 100 | purple | No | Bath turbid |
| 46 | " | 11 | No | 6.4 | — | 100 | orange/ pink | Marginal | Solution decomposed |
| 47 | " | 9 | Yes | 9.7 | — | 100 | pink | Yes | |
| 48 | " | 9 | No | 12.1 | — | 100 | pink | Yes | |
| 49 | " | 6 | Yes | — | — | — | dk. brown | No | Smut deposit |
| 50 | " | 6 | No | 3.8 | — | 100 | dk.brown/ pink | No | Smut deposit |
| 51 | " | 4 | Yes | — | — | — | — | No | No plate |
| 52 | " | 4 | No | — | — | — | — | No | No plate |
| 53 | " | 2.5 | Yes | — | — | — | — | No | No plate |
| 54 | " | 2.5 | No | — | — | — | — | No | No plate |
| 55 | 0.68 | 12 | No | 10.1 | — | 100 | purple | No | |
| 56 | " | 9 | No | 10.5 | — | 100 | pink | Yes | Some blotches |
| 57 | " | 6 | No | — | — | 100 | reddish pink | No | Smut deposit |
| 58 | 0.34 | 9 | No | 10.0 | 9.5 | 100/ 100 | pink/pink | Yes | |
| 59 | 0.68 | 9 | No | 9.8 | 9.2 | 100/ 100 | pink/pink | Yes | Some blotches |
| 60 | 0.34 | 9 | No | 7.2 | — | 100 | pink | Yes | Surfactant #1 |
| 61 | " | 9 | No | 10.9 | — | 100 | pink | Yes | Surfactant #2 |
| 62 | " | 9 | No | 9.8 | — | 100 | reddish pink | Yes | Surfactant #3 |
| 63 | " | 9 | No | 10.5 | — | 100 | pink | Yes | Surfactant #4 |

The examples of Table C all containing NTA as the complexer show similar trends in operating conditions when compared with those of Tables A and B; however the operating range of pH is somewhat narrower in this case, the optimum range being pH 8–10 and the preferred condition being close to 9, whereas the HEEDTA and EDTA complexed systems as has been shown exhibit a broader range of 5 to 11, with an optimum of from about 6 to 10 pH. The NTA baths are again not significantly affected by inclusion of nickel ion, nor by inclusion of standard wetting agents.

Sodium potassium tartrate is another complexer commonly used heretofore in formaldehyde-reduced electroless copper baths, and it is also useful in the baths of the present invention. It appears that with this complexer the optimum pH is around 10–12, as the examples in Tables D show. At this pH level, the inclusion of nickel appears to provide no significant improvement in terms of copper thickness obtained in the selected test period.

TABLE D

| | | COMPLEXER - SODIUM POTASSIUM TARTRATE @ 0.148M $Cu^{++}$ @ 0.06M | | | | | | |
|---|---|---|---|---|---|---|---|---|
| | | (a) | | (b) | (c) | | (d) | |
| Ex. No. | Moles Reduc. | pH | Ni | Plate Thickness 10 Min. | % Cover | Deposit Color | Accpt. | Comment |
| 64 | 0.34 | 2.5 | No | — | — | — | No | No Plate Bath precipitated |
| 65 | " | 2.5 | Yes | — | — | — | No | No Plate Bath precipitated |
| 66 | " | 4.0 | No | — | — | — | No | No Plate Bath precipitated |
| 67 | " | 4.0 | Yes | — | — | — | No | No Plate Bath precipitated |
| 68 | " | 6.0 | No | — | — | — | No | No Plate |
| 69 | " | 6.0 | Yes | — | — | — | No | No Plate |
| 70 | " | 9.0 | No | (13) | 100 | Brown/ Orange | Marginal | Solution Turbid |
| 71 | " | 9.0 | Yes | (12) | 100 | Brown/ Orange | Marginal | Solution Turbid |
| 72 | 10.0 | No | 17 | 100 | Stained | Yes Copper | Deposit appears | tarnished upon removal from solution |
| 73 | " | 11.0 | No | 19 | 100 | Stained Copper | Yes | Deposit appears tarnished upon removal from solution |
| 74 | " | 11.0 | Yes | 16 | 100 | Stained Copper | Yes | Deposit appears tarnished upon removal from solution |
| 75 | " | 12.0[1] | No | (13) | 100 | Stained Copper | Marginal | Deposit appears tarnished upon removal from solution |
| 76 | " | 12.0[1] | Yes | (9) | 100 | Stained Copper | Marginal | Deposit appears tarnished upon removal from solution |
| 77 | " | 12.5[2] | No | (7) | 100 | Stained Copper | Marginal | Deposit appears tarnished upon removal from solution |
| 78 | " | 12.5[2] | Yes | (9) | 100 | Stained Copper | Marginal | Deposit appears tarnished upon removal from solution |
| 79 | " | 12.8[3] | No | (8) | 100 | Stained Copper | Marginal | Deposit appears tarnished upon removal from solution |
| 80 | " | 12.8[3] | Yes | (17) | 100 | Stained Copper | Marginal | Deposit appears tarnished upon removal from solution |
| 81 | " | 13.1[4] | No | (10) | 100 | Stained Copper | Marginal | Deposit appears tarnished upon removal from solution |
| 82 | " | 13.1[4] | Yes | (22) | 100 | Stained Copper | Marginal | Deposit appears tarnished upon removal from solution |
| 83 | " | 13.4[5] | No | (10) | 100 | Stained Copper | No | Deposit appears tarnished upon removal from solution |
| 84 | " | 13.4[5] | Yes | (27) | 100 | Stained Copper | No | Deposit appears tarnished upon removal from solution |
| 85 | " | 13.7[6] | Yes | (29) | 100 | Stained Copper | No | Deposit appears tarnished upon removal from solution |
| 86 | 0.68 | 9.0 | Yes | (13) | 100 | Stained Copper | Marginal | Deposit appears tarnished upon removal from solution |
| 87 | " | 10.0 | Yes | 28 | 100 | Stained Copper | Yes | Deposit appears tarnished upon removal from solution |
| 88 | " | 11.0 | Yes | 22 | 100 | Stained Copper | Yes | Deposit appears tarnished upon removal from solution |
| 89 | " | 12.5 | Yes | (12) | 100 | Stained Copper | Marginal | Deposit appears tarnished upon removal |

TABLE D-continued

| COMPLEXER - SODIUM POTASSIUM TARTRATE @ 0.148M $Cu^{++}$ @ 0.06M | | | | | | | | |
|---|---|---|---|---|---|---|---|---|
| | | (a) | | (b) | (c) | | (d) | |
| Ex. No. | Moles Reduc. | pH | Ni | Plate Thickness 10 Min. | % Cover | Deposit Color | Accpt. | Comment |
| | | | | | | | | from solution |
| 90 | 0.34 | 11.0 | Yes | 11 | 100 | Stained Copper | Yes | Surfactant #1 |
| 91 | " | 11.0 | Yes | 12 | 100 | Stained Copper | Yes | Surfactant #2 |
| 92 | " | 11.0 | Yes | 12 | 100 | Stained Copper | Yes | Surfactant #3 |
| 93 | " | 11.0 | Yes | 11 | 100 | Stained Copper | Yes | Surfactant #4 |

(a) $NiCl_2 . 6H_2O$ @ 0.002M
(b) Plate thickness where reported in parenthesis is calculated on the assumption the deposit is pure copper.
(c) Surface coverage
(d) In this system many deposits were obtained which gave the appearance of tarnished or stained copper film in contrast to a bright pink deposit. However utilization of a 5% sulfuric acid dip prior to subsequent electroplating reveals a pink copper deposit on pieces noted as acceptable.
pH Notes - (free caustic)
[1]0.3 Grams/liter free caustic
[2]2 Grams/liter free caustic
[3]5 Grams/liter free caustic
[4]10 Grams/liter free caustic
[5]20 Grams/liter free caustic
[6]40 Grams/liter free caustic In Table D all bath compositions are 0.06 molar in copper. Examples 64–85 illustrate the effect of varying the pH of the bath while the reducer concentration (0.34 M) and complexer concentration (0.148 M) are kept constant. The examples also provide a comparison of copper deposits obtained with and without nickel ion.

Here again it is demonstrated that for this complexer only a certain range of pH values will give copper deposits acceptable for subsequent electrolytic plating. As noted, at least marginally acceptable deposits obtained in the pH range of 9–13; however the range of 10–11 is optimum.

The inclusion of nickel ion, at least in preferred pH range indicated above, again appears to have little effect on the system.

Doubling the reducer concentration shows some rate increase, especially in the preferred pH range of 10–11. Even at the higher reducer concentration, however, the bath does not show signs of instability.

Examples 90–93 demonstrate that usual surfactants can be incorporated in the baths without any adverse effect on the plate obtained.

In general it is found that the tartrate bath produces deposits which, when removed from solution, appear tarnished or stained. However, subsequent dip in 5–10% sulfuric acid prior to electroplating appears to remove that tarnish and reveal a pink copper deposit. It is also observed that incorporation of wetters into the system diminish or eliminate this tarnish or stained effect. The tarnished deposit obtained in the tartrate system is not to be confused with the dark brown or smutty deposits obtained in some of the other systems reported above which were poorly conductive and unacceptable for subsequent electroplating.

Additional hypophosphite-reduced copper solutions employing other complexers than those specifically mentioned but commonly used in formaldehyde type electroless copper baths also show operativeness, but the conditions required for acceptable plated copper deposits appear to be more restricted. Complexers such as N,N,N',N'-tetrakis (2 hydroxypropyl) ethylenediamine, iminodiacetic acid, methanol amine, for example, require a more restricted pH range of operation to provide any useful results. In accordance with the discovery of the present invention, however, it is thus seen that hypophosphite ion can serve as a useful reducing agent in electroless copper solution for many applications, if the bath pH is coordinated with the type of complexer employed. Having such basic understanding, many combinations of hypophosphite and complexer, or mixtures of complexers, become possible and the particular pH range for optimum operation than can be readily determined through routine trial by the artisan.

In the copper deposits formed from the invention baths incorporating the hypophosphite reducing agent, it is postulated, based on presently available evidence, that the resulting copper deposit may in fact be a copper-phosphorous alloy of unique properties resulting from the method of preparation. Certainly the deposit is essentially or predominantly copper, but the inclusion of small amount of phosphorous may account for some of the differences in hardness, conductivity, etc. that seem to exist in comparison with copper deposits obtained from formaldehyde-type electroless copper solutions.

EXAMPLES V–VIII

In order to further illustrate the capacity of the invention baths to accommodate substantial change in component concentration without adverse effect on the copper deposit, the following data is representative of the results obtained:

| | EXAMPLES | | | |
|---|---|---|---|---|
| Bath composition | V | VI | VII | VIII |
| $CuCl_2 . 2H_2O$ | 0.030M | 0.060M | 0.120M | 0.240M |
| "Hamp-01" (HEEDTA) | 0.037M | 0.074M | 0.148M | 0.296M |
| $NaH_2PO_2 . H_2O$ | 0.340M | 0.340M | 0.340M | 0.340M |
| pH | 9.1 | 9.1 | 9.1 | 9.1 |
| Thickness of Deposit in 10 Minutes (microinch) | 7.86 | 11.12 | 13.98 | 19.16 |
| Color | Pink | Pink | Pink | Pink |
| Coverage % | 100 | 100 | 100 | 100 |
| Acceptability for Subsequent | Yes | Yes | Yes | Yes |

-continued

| Bath composition | EXAMPLES V | VI | VII | VIII |
|---|---|---|---|---|
| Electroplating | | | | |

ABS panels were used and processed through normal preplate techniques, as already described in connection with preceding examples. As Examples V–VIII show, all deposits completely covered the panel surfaces with a bright pink adherent deposit. The complexer concentration ("Hamp-Ol" crystals) was increased proportionately with the copper concentration to insure that all copper was chelated. The results show an increasing deposition rate with increasing copper concentration, and effectively illustrate the wide operating range of the solution. Acceptable operating parameters for the copper concentration would be, as a minimum, an amount sufficient to obtain deposition; and, as a maximum, an amount which would still maintain acceptable solubility of the bath constituents. Naturally, extremely high concentrations would add to the cost of operation through drag-out of a more concentrated solution. Also a maximum concentration would be reached at such point where precipitation of various components occurs. The balance would be determined by what is acceptable in practice in any given situation.

The data presented in the foregoing tables is based on use of standard platable grade of ABS substrate, such as Monsanto PG 298, used in plating of plastics with conventional formaldehyde-type electroless copper baths. Tests made on other substrates molded of standard plating grade thermoplastics, such as "Noryl" (polyphenylene oxide) and polypropylene, show that the invention baths are applicable to those as well. Also thermosetting substrates of the phenol-formaldehyde as well as epoxy types can be plated in the invention baths, as can other types of thermoset plastics.

The invention is especially applicable to plating on plastic; that is, to applications where the plated part or workpiece is required to have a metal finish for decorative or protective purposes. Automobile, appliance and hardware parts are fields in which such applications more frequently arise. In such applications it is usually most practical to apply, initially, a thin deposit of copper by electroless deposition, after which additional thicknesses of copper, nickel, chromium, for example, or other metal can be added more rapidly and economically by standard electrodeposition procedures. The hypophosphite-reduced electroless copper baths of this invention are particularly suited for such applications. In this system the plating rate of copper on palladium/-tin catalyzed plastic substrates is initially fast but slows as the copper thickness builds. It is assumed that this occurs because the copper deposit is not as catalytic to the system as is the palladium/tin. This however is an advantage in situations requiring only a thin conductive copper coating, as in plating on plastics, since any extraneous plate-out on tank walls, racks, heater coils, etc. will be inherently self-limiting and therefore reduces the extraneous plate-out and consequent tank clean-out and rack maintenance problems.

The preparation of the surface of the plastic substrate, particularly for plating on plastic applications, generally includes the chromic-sulfuric or all-chromic etch procedure mentioned above. The copper baths of the invention can be used, however, for printed circuit-board applications employing, for example, the "PLADD" process of MacDermid Incorporated, Waterbury, Connecticut, disclosed in U.S. Pat. No. 3,620,933. In that system, a different substrate preparation is used, preliminary to electroless deposition of the copper. This is illustrated by the following example.

EXAMPLE IX

The workpiece here is to comprise a printed circuit board which takes the form initially of a blank laminate consisting of aluminum foil bonded to a fiberglass reinforced epoxy resin substrate. In preparing the circuitboard, this blank laminate is placed in a hydrochloric acid bath to chemically strip off the aluminum foil, leaving the surface of the resin substrate especially suited for subsequent reception of electroless metal deposition. This preliminary operation replaces the chromic-sulfuric etch step mentioned previously. The stripped substrate, after careful rinsing, is then catalyzed, following the same procedure of palladium-tin catalysis described in Example I. The catalyzed board is then copper plated, using the same copper solution described in that earlier example. This produces a thin copper deposit across the entire surface of the substrate. A mask or resist is then applied, as by screening, photopolymeric development, etc., to define a desired printed circuit. The masked (thin-plated) substrate is then further plated in an electrolytic bath, using the initial electroless deposit as a "bus" to build up additional metal thickness in the unmasked regions of the circuitboard. The resist or mask is next chemically dissolved and the board is placed in a suitable copper etchant solution, such as that disclosed in U.S. Pat. No. 3,466,208, for a time sufficient to remove the thin initial copper deposit previously covered by the resist, but insufficient to remove the substantially thicker regions of copper (or other metal) deposit built up in the electrolytic plating bath. This technique is sometimes referred to in the art as a semi-additive plating process.

In similar manner, the invention is applicable to the "subtractive" procedure for preparation of printed circuit boards having through-holes for interconnecting conductor areas on opposite surfaces of standard copper foil clad laminates. The through-holes are punched in the blank board and the walls of the through-holes plated with copper electrolessly, using the copper solution of this invention. Additional thickness of the wall deposit can be provided by electrolytic deposition, if desired. A resist is applied to produce a prescribed circuit pattern, and the exposed copper foil is then etched away, leaving the circuit pattern and through-hole interconnections. The resist may or may not then be removed, depending on further plating requirements, such as gold plating of connector tab areas on the circuit, solder coating, etc.

Although specific embodiments of the present invention have been described above in detail, it is to be understood that these are primarily for purposes of illustration. Modifications may be made to the particular conditions and components disclosed, consistent with the teaching herein, as will be apparent to those skilled in the art, for adaptation to particular applications.

What is claimed is:

1. An electroless copper deposition solution comprising, in addition to water, a soluble source of cupric ions, a complexing agent effective to maintain said cupric ions in solution at pH levels between 5 and 13, and a reducing agent effective to reduce cupric ions to copper as a deposited conductive metal film on a catalyzed non-conductive surface of a substrate when in contact with said solution, wherein said reducing agent is a soluble source of hypophosphite ions; said complexing agent is selected to be effective at pH levels between 5 an 13 for complexing cupric ions; and said solution pH is coordinated within said range of 5 to 13 for each complexer selected to give said deposited conductive copper film.

2. An electroless copper deposition solution as defined in claim 1, which includes a pH adjuster to alter the bath pH within said selected range, said adjuster being hydrochloric or sulfuric acid or sodium or potassium hydroxide.

3. An electroless copper deposition solution comprising, in addition to water, a soluble source of cupric ions, a complexing agent to maintain said cupric ions in solution and a reducing agent effective to reduce the cupric ions to essentially metallic copper as a deposited metal film on a catalyzed non-conductive surface of a substrate when in contact with said solution, said copper film having sufficient thickness and conductivity to support electrodeposition of further metal thereon; wherein said reducing agent is a soluble source of hypophosphite ions and said complexing agent is selected from the group consisting of HEEDTA, EDTA, NTA, soluble tartrates and mixtures thereof; said bath having a pH of from about 5 to 11 where the complexer is HEEDTA, EDTA or NTA, and from about 9 to 13 where the complexer is a tartrate.

4. An electroless copper deposition solution as defined in claim 3, which includes a pH adjuster to alter the pH of the bath within said ranges of 5 to 11 and 9 to 13 pH, respectively.

5. An electroless copper deposition solution as defined in claim 3, wherein the copper ion concentration is from about 0.03 to 0.24 M.

6. An electroless copper deposition solution as defined in claim 3, wherein the thickness and conductivity of said deposited copper film is sufficient to support electrodeposition without burn-off of a further metal thereon at an initial current rate of about 20 amperes per square foot and 2 volts.

7. An electroless copper deposition solution comprising, in addition to water, a soluble source of cupric ions in solution at a concentration of from about 0.03 to 0.24 M, HEEDTA as a complexer for said cupric ions at a concentration essentially equal to the mole concentration of the cupric ion, and a reducing agent effective to reduce the cupric ions to essentially metallic copper as a deposited metal film on a catalyzed surface of a substrate when in contact with said solution, wherein said reducing agent is a soluble source of hypophosphite ions; said bath having a pH of from about 5 to 11.

8. An electroless copper deposition solution as defined in claim 7, wherein the concentration of the cupric ion is about 0.06 M and the concentration of the reducing agent is about 0.340 M.

9. An electroless copper deposition solution as defined in claim 8, wherein the pH of the bath is about 6.

10. An electroless copper deposition solution as defined in claim 8, wherein the pH of the bath is about 9.

11. An electroless copper deposition solution comprising, in addition to water, a soluble source of cupric ions in solution at a concentration of from about 0.03 to 0.24 M, EDTA as a complexer for said cupric ions at a concentration essentially equal to the mole concentration of the cupric ion, and a reducing agent effective to reduce the cupric ions to essentially metallic copper as a deposited metal film on a catalyzed surface of a substrate when in contact with said solution, wherein said reducing agent is a soluble source of hypophosphite ions; said bath having a pH of from about 5 to 11.

12. An electroless copper deposition solution as defined in claim 11, wherein the concentration of cupric ion is about 0.06 M and the concentration of the reducing agent is about 0.340 M.

13. An electroless copper deposition solution as defined in claim 12, wherein the pH of the bath is about 6.

14. An electroless copper deposition solution as defined in claim 12, wherein the pH of the bath is about 9.

15. An electroless copper deposition solution comprising, in addition to water, a soluble source of cupric ions in solution at a concentration of from about 0.03 to 0.24 M, NTA as a complexer for said cupric ions at a concentration essentially equal to about twice the mole concentration of the cupric ion, and a reducing agent effective to reduce the cupric ions to essentially metallic copper as a deposited metal film on a catalyzed surface of a substrate when in contact with said solution, wherein said reducing agent is a soluble source of hypophosphite ions; said bath having a pH of about 5 to 11.

16. An electroless copper deposition solution as defined in claim 15, wherein the concentration of cupric ion is about 0.06 M and the concentration of the reducing agent is about 0.340 M.

17. An electroless copper deposition solution as defined in claim 16, wherein the pH of the bath is about 9.

18. An electroless copper deposition solution comprising, in addition to water, a soluble source of cupric ions at a concentration of from about 0.03 to 0.24 M, an alkali metal tartrate as a complexer for said cupric ions at a concentration essentially equal to about twice the mole concentration of the cupric ion, and a reducing agent effective to reduce the cupric ions to essentially metallic copper as a deposited metal film on a catalyzed surface of a substrate when in contact with said solution, wherein said reducing agent is a soluble source of hypophosphite ions; said bath having a pH of about 9 to 13.

19. An electroless copper deposition solution as defined in claim 18, wherein the concentration of cupric ion is about 0.03 M and the concentration of the reducing agent is about 0.340 M.

20. An electroless copper deposition solution as defined in claim 19, wherein the pH of the bath is about 10–12.

* * * * *